US011939544B2

(12) United States Patent
Koselek et al.

(10) Patent No.: US 11,939,544 B2
(45) Date of Patent: Mar. 26, 2024

(54) DECOKING PROCESS

(71) Applicant: NOVA CHEMICALS (INTERNATIONAL) S.A., Fribourg (CH)

(72) Inventors: Michael Koselek, Calgary (CA); Leslie Benum, Alberta (CA); Vasily Simanzhenkov, Calgary (CA); Hany Farag, Calgary (CA)

(73) Assignee: NOVA Chemicals (International) S.A., Fribourg (CH)

( * ) Notice: Subject to any disclaimer, the term of this patent is extended or adjusted under 35 U.S.C. 154(b) by 0 days.

(21) Appl. No.: 17/429,898

(22) PCT Filed: Feb. 7, 2020

(86) PCT No.: PCT/IB2020/050987
§ 371 (c)(1),
(2) Date: Aug. 10, 2021

(87) PCT Pub. No.: WO2020/165710
PCT Pub. Date: Aug. 20, 2020

(65) Prior Publication Data

US 2022/0098492 A1 Mar. 31, 2022

(30) Foreign Application Priority Data

Feb. 12, 2019 (CA) ..... CA 3033604

(51) Int. Cl.
*C10G 9/16* (2006.01)

(52) U.S. Cl.
CPC ..... *C10G 9/16* (2013.01); *C10G 2300/4075* (2013.01)

(58) Field of Classification Search
CPC ..... C10G 9/16; C10G 2300/4075
See application file for complete search history.

(56) References Cited

U.S. PATENT DOCUMENTS

| | | | | | |
|---|---|---|---|---|---|
| 3,532,542 | A * | 10/1970 | Kinichi | C10G 9/16 | 134/2 |
| 4,889,614 | A | 12/1989 | Forester | | |
| 5,298,091 | A | 3/1994 | Edwards, III et al. | | |
| 5,446,229 | A * | 8/1995 | Taylor | C10G 9/16 | 585/653 |
| 5,575,902 | A * | 11/1996 | Heyse | C23C 26/00 | 208/48 R |
| 5,777,188 | A * | 7/1998 | Reed | C10G 9/16 | 585/653 |
| 6,602,483 | B2 | 8/2003 | Heyse et al. | | |
| 8,152,993 | B2 | 4/2012 | De Haan et al. | | |
| 8,791,314 | B2 | 7/2014 | Fremy et al. | | |
| 10,894,276 | B2 * | 1/2021 | Koselek | C10G 9/16 | |
| 2002/0029514 | A1 * | 3/2002 | Lindstrom | C10G 9/16 | 44/640 |
| 2004/0216815 | A1 * | 11/2004 | Cai | C23C 8/02 | 148/633 |
| 2007/0232845 | A1 * | 10/2007 | Baumgartner | C10G 9/14 | 422/198 |
| 2010/0069695 | A1 * | 3/2010 | Fremy | C10G 9/16 | 585/650 |
| 2014/0024873 | A1 * | 1/2014 | De Haan | C10G 75/00 | 422/198 |
| 2018/0281033 | A1 | 10/2018 | Koselek et al. | | |

FOREIGN PATENT DOCUMENTS

| | | |
|---|---|---|
| EP | 0591856 | 4/1994 |
| WO | WO2018178810 | 10/2018 |

OTHER PUBLICATIONS

Symoens et al., "State-of-the-art of coke formation during steam cracking: Anti-coking surface technologies," Industrial & Engineering Chemistry Research, Oct. 2018, 57(48):16117-16136.

* cited by examiner

*Primary Examiner* — Michelle Stein
(74) *Attorney, Agent, or Firm* — Fish & Richardson P.C.

(57) ABSTRACT

In chemical processes for cracking hydrocarbons, reactors are subject to coking. This results in carburization of the metal substrate for the reactor leading to a reduced reactor life. If the reactor is subject to a decoke process, followed by a steam scour and nitrogenating there is a reduced tendency to carburization of the metal substrate improving the reactor life.

13 Claims, 1 Drawing Sheet

DECOKING PROCESS

CROSS REFERENCE TO RELATED APPLICATIONS

This application is a United States National Phase Filing of International Patent Application No. PCT/IB2020/050987, which was filed on Feb. 7, 2020 which claims the benefit of the filing date of Canadian Application No. 3033604, which was filed on Feb. 12, 2019. The contents of International Patent Application No. PCT/IB2020/050987 and Canadian Application No. 3033604 are incorporated herein by reference in their entirety as part of this application.

TECHNICAL FIELD

The present invention relates to the field of decoking industrial apparatuses operating at elevated temperatures in a hydrocarbon containing environment. The apparatuses are typically taken off-line or may require being shut down on a periodic basis to remove coke accumulated on the internal surfaces of the device. The process of the present invention is suitable for decoking any cracking process where larger hydrocarbon molecules are converted to smaller molecules at elevated temperatures and coke is a byproduct on the cracking tubes or reactors, such as a fluid catalyst cracker or a steam cracker to produce alkenes from alkanes at elevated temperatures.

BACKGROUND ART

In an industrial steam cracker there are typically a number of "furnaces". Within the furnace are metal coils or passes which pass through a furnace at an elevated temperature typically above about 750° C., usually in the range of 800° C. to 900° C. At these temperatures the feed, typically an alkane, usually a lower molecular weight alkane such as ethane, propane, butane and mixtures thereof, or heavier feed stock including naphtha, heavy aromatic concentrate (HAC) and heavy aromatic gas oil (HAGO) or any of the vacuum gas oils, undergoes a rearrangement yielding alkenes, including but not limited to ethylene, propylene and butene and hydrogen and other coproducts. Over time carbon and coke build up on the internal surface of the pass increasing the pressure drop across the tube and reducing the thermal and cracking efficiency process in that tube or coil. The coil is taken off line (hydrocarbon is no longer fed to the coil) and the coil is decoked and then returned to operation.

In decoking a steam cracker several different methods are available. In one method the coke is physically scoured from the internal reactor walls. Typically, a relatively high velocity stream of air, steam or a mixture there of passes through the coil resulting in small particulate materials being included in the stream. As the particulates pass through the furnace tube or coil, the coke on the internal wall is scoured off. One issue with this type of treatment is the erosion of the internal surface of the tube or pass, fittings and downstream equipment. An additional concern with this type of treatment is downstream plugging with coke particulates scoured from the walls.

An alternate treatment to decoke the furnace tube is to "burn" the carbon out. When the tube is taken off line, air and steam are passed through the tube at a high temperature to cause the coke to burn. The progress of the process may be measured in a number of different ways including measuring the carbon dioxide and carbon monoxide content in gasses leaving the furnace, measuring the tube metal temperature or the outlet temperature of the furnace.

U.S. Pat. No. 8,152,993 issued Apr. 10, 2012 to DeHaan et al., assigned to Lummus Technology Inc., teaches one method to decoke a furnace tube by burning out the coke. The patent does not teach or suggest any additional treatment or component in the gas passing through the furnace tube other than steam or air.

U.S. Pat. No. 6,602,483 issued Aug. 5, 2003 to Heyse et al, assigned to Chevron Phillips from an application having an earliest filing date of Jan. 4, 1994 (now expired) teaches a chemicals conversion process such as steam cracking wherein at least a portion of the reactor is clad with a group VIB metal (e.g. Cr). The cladding prevents carburization of the internal reactor surface.

There are a series of patents in the name of Benum assigned to NOVA Chemicals which teach forming a spinel surface on the interior surface of furnace tubes to reduce coke formation.

There are patents which teach the use of sulphur additives to the feedstock to reduce the formation of coke. One example of such art is U.S. Pat. No. 8,791,314 issued Jul. 29, 2014 to Fremy et al., assigned to Arkema France.

The above art does not teach the burn out decoking procedures.

U.S. Pat. No. 5,298,091 issued Mar. 29, 1994 to Edwards III, assigned to United Technologies Corporation teaches nitrogenating the surface of components of a jet engine which come in contact with hydrocarbons at elevated temperatures. The patent teaches nitrogenating the metal surface at a temperature from about 1800° F. to 1850° F. (about 1000° C.) in an atmosphere selected from nitrogen, nitrogen and hydrogen and ammonia. The treated steel is then cooled at a controlled rate. The patent teaches against an atmosphere comprising steam and nitrogen in a weight ratio from 1:4 to 2:4.

The present invention seeks to provide a decoking procedure which is simple and helps to provide an enhanced surface on the parts of the equipment in contact with a hydrocarbon environment to resist coking.

SUMMARY OF INVENTION

In one embodiment the present invention provides in the decoking of a reactor for the conversion of a chemicals feedstock at a temperature greater than 700° C. the final step comprising treating a scoured reactor surface which contacts the hydrocarbons with a mixture comprising steam and nitrogen in a weight ratio from 20:1 to 30:1 in an amount from 80 to 100 kg/hour per reactor (furnace pass) at a temperature from 750° C. to 850° C. for a time not less than 10 minutes, in the presence of trace amounts of oxygen in the steam, typically less than 10 parts per billion (ppb), desirably less than 5 ppb, in some embodiments less than 1 ppb of oxygen.

In a further embodiment the reactor comprises stainless steel selected from the group consisting of wrought stainless, austenitic stainless steel and HP, HT, HU, HK HW and HX stainless steel, heat resistant steel, and nickel based alloys.

In a further embodiment the scouring comprises treating the surface of the reactor which contacts hydrocarbons with a steam scour at a rate of not less than 500 kg/hour/reactor for a time from 0.25 to 1 hours.

In a further embodiment the reactor has been previously subject to a decoking air burn for a period of time sufficient so that the air stream leaving the reactor has a total carbon content less than 5,000 ppm.

In a further embodiment subsequent to, or concurrent with the treatment with nitrogen and steam the reactor is optionally treated with a chemical to reduce coking selected from the group consisting of compounds of the formula $RS_nR'$ with n being the mean sulphur number ranging from 1 to 12 and R and R' selected from the group consisting of H and a linear or branched $C_1$-$C_6$ alkyl, cycloalkyl or aryl radicals in an amount from 50 ppm to 2,500 ppm.

In a further embodiment the stainless steel comprises not less than 16 weight % of chromium.

In a further embodiment the steel is selected from the group consisting of 315 stainless steel, 316 stainless steel, austenitic stainless steel and HP, HT, HU, HW and HX stainless steel.

In a further embodiment during or subsequent to decoking no chemical to reduce coking is added to the reactor.

In a further embodiment the treated surface of the reactor is nitrogenated to a surface thickness from about 0.00001 to about 0.00005 inches.

In a further embodiment the reactor is a cracker for $C_{2-4}$ hydrocarbons.

In a further embodiment the reactor is a cracker for naphtha, HAC (heavy aromatic concentrate) and or HAGO (heavy aromatic gas oils).

DESCRIPTION OF EMBODIMENTS

Numbers Ranges

Figure 1:
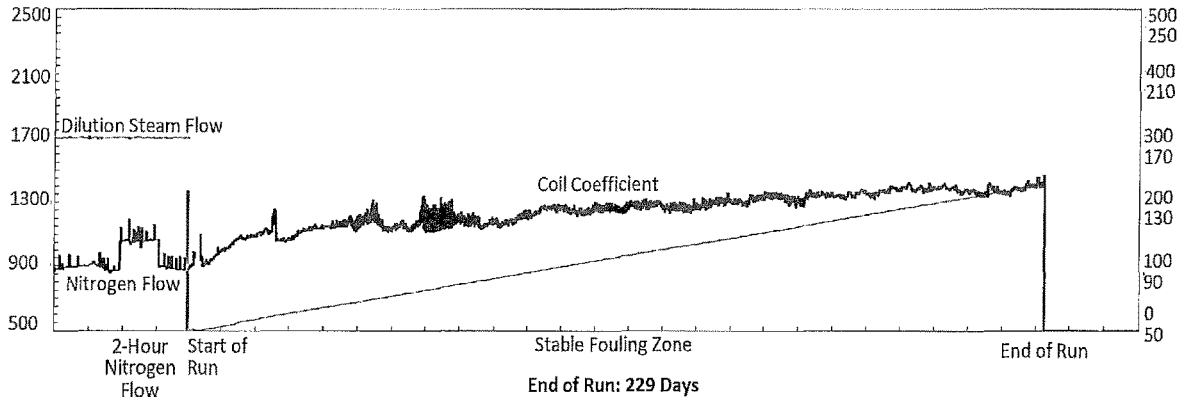
FIG. 1 shows the fun time of the furnace treated in accordance with Example 1.

Other than in the operating examples or where otherwise indicated, all numbers or expressions referring to quantities of ingredients, reaction conditions, etc. used in the specification and claims are to be understood as modified in all instances by the term "about". Accordingly, unless indicated to the contrary, the numerical parameters set forth in the following specification and attached claims are approximations that can vary depending upon the properties that the present invention desires to obtain. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

Also, it should be understood that any numerical range recited herein is intended to include all sub-ranges subsumed therein. For example, a range of "1 to 10" is intended to include all sub-ranges between and including the recited minimum value of 1 and the recited maximum value of 10; that is, having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

All compositional ranges expressed herein are limited in total to and do not exceed 100 percent (volume percent or weight percent) in practice. Where multiple components can be present in a composition, the sum of the maximum amounts of each component can exceed 100 percent, with the understanding that, and as those skilled in the art readily understand, that the amounts of the components actually used will conform to the maximum of 100 percent.

Lower alkanes are typically cracked at temperatures from about 750° C. to about 950° C. in some embodiments from about 800° C. to about 900° C. as the feed passes through a heated pipe or coil or pass for a period of time from about 0.001 to 0.1 seconds. During the reaction the molecules of feed decompose and the components recombine to form the desired alkene, hydrogen and by products. The reaction takes place under aggressive conditions which also lead to the formation of coke which deposits on the internal walls of the reactor or furnace tube or pass. This coke must be removed as the pressure drop across the reactor, or tube increases and the thermal conductivity across the reactor wall or furnace tube wall decreases.

In one embodiment of the present invention the coke is removed by burning. A mixture of steam and air is passed through the coil while it is maintained at an elevated temperature from about 780° C. to about 900° C., in some embodiments from 790° C. to 850° C. in some embodiments from 800° C. to 830° C. The amount of air fed to the tube or coil depends on the furnace and the tube design. In some instances, the air may be fed to the coil at a rate from about 10 kg/hour to about 400 kg/hour. Dilution steam is fed to the reactor to provide an initial weight ratio of steam to air from about 200:1 to about 170:3. The decoke is completed when the amount of carbon oxides ($CO_2$ and CO) in the exhaust stream from the tube or coil is below about 2,000 ppm. In some embodiments of the procedure, the rate of air feed to the coil may be increased up to about 1000 kg/hour/reactor as a post burn, surface polishing step.

During the decoke procedure the temperature in the combustion side of the cracker (sometimes called the radiant box) may range from about 790° C. to about 1100° C.

The rate of decoking needs to be controlled to minimize or limit spelling of coke from the coil as this may interfere with downstream operation. Also during decoking the temperature of the tube should be maintained as uniform as possible to prevent damage to the tube.

The decoking may be finished with a steam scour at a steam feed rate of not less than 2500 kg/hour/reactor fora time from 0.5 to 10 hours, in some embodiments from about 6 to 9 hours under the same temperature conditions as the burn out decoke.

Polish

When the concentration of carbon oxides at the coil exit is below or about 2,000 ppm the airflow to the coil is stopped. A mixture of steam and purified nitrogen (at least 99.99% pure less than 5 ppm of oxygen preferably less than 2 ppm oxygen with only trace levels of CO and $CO_2$) is fed to the reactor in a weight ratio from 20:1 to 30:1 in an amount from 80 to 100 kg/hour per reactor pass at a temperature from 750° C. to 850° C. This is done in the absence of any added air or oxygen (the oxygen level in the steam was less than 10 ppb). The treatment is continued for a period of time not less than 10 minutes in some instances up to 5 hours, preferably between 1 and 2 hours. In some instances, the coil may be further subject to a high temperature hold or soak treatment at a temperature from about 800° C. to about 850° C., preferably less than 830° C. for a further time from about 20 minutes to an hour, preferably from about 25 to 45 minutes, in some embodiments from 25 to 35 minutes.

The treatment results in the nitrogenating of the surface of the steel substrate. The surface of the steel substrate is nitrogenated to a surface thickness from about 0.00001 to about 0.00005 inches.

In some embodiments an anti-coking agent may also be included in the steam/nitrogen feed for the polish treatment or subsequent to the polish treatment. Many anti-coking agents are known to those skilled in the art. In some embodiments the anti-coking agent may be selected from the group consisting of compounds of the formula $RS_nR'$ with n being the mean sulphur number ranging from 1 to 12 and R and R' selected from the group consisting of H and a linear or branched $C_1$-$C_6$ alkyl, cycloalkyl or aryl radicals. The anti-coking agent is added to the polish feed or a steam feed if the treatment is subsequent to the polish in an amount from 15 ppm to 2,500 ppm. For a period of time from 0.5 to 12, hours, preferably from about 1 to 6 hours.

The present invention is applicable to steels typically comprising at least 12 weight % Cr, preferably at least 16 weight % of Cr. The steel may be selected from the group consisting of 304 stainless steel, 310 stainless steel, 315 stainless steel, 316 stainless steel, austenitic stainless steel and HP, HT, HU, HK, HW and HX stainless steel.

In one embodiment the stainless steel, preferably heat resistant stainless steel typically comprises from 13 to 50, preferably 20 to 50, most preferably from 20 to 38 weight % of chromium. The stainless steel may further comprise from 20 to 50, preferably from 25 to 50 most preferably from 25 to 48, desirably from about 30 to 45 weight % of Ni. The balance of the stainless steel is substantially iron.

The present invention may also be used with nickel and/or cobalt based extreme austenitic high temperature alloys (HTAs). Typically, the alloys comprise a major amount of nickel or cobalt. Typically, the high temperature nickel based alloys comprise from about 50 to 70, preferably from about 55 to 65 weight % of Ni; from about 20 to 10 weight % of Cr; from about 20 to 10 weight % of Co; and from about 5 to 9 weight % of Fe and the balance one or more of the trace elements noted below to bring the composition up to 100 weight %. Typically, the high temperature cobalt based alloys comprise from 40 to 65 weight % of Co; from 15 to 20 weight % of Cr; from 20 to 13 weight % of Ni, less than 4 weight % of Fe and the balance one or more trace elements as set out below and up to 20 weight % of W. The sum of the components adding up to 100 weight %.

In some embodiments of the invention, the substrate may further comprise at least 0.2 weight %, up to 3 weight % typically 1.0 weight %, up to 2.5 weight % preferably not more than 2 weight % of manganese from 0.3 to 2, preferably 0.8 to 1.6 typically less than 1.9 weight % of Si; less than 3, typically less than 2 weight % of titanium, niobium (typically less than 2.0, preferably less than 1.5 weight % of niobium) and all other trace metals; and carbon in an amount of less than 2.0 weight %.

The present invention may also be used with 35 weight % nickel and 45 weight % chromium based alloys with an amount of aluminum of up to 4% with a propensity to form an aluminum oxide layer or an alumina layer on the inner surface of a reactor or pass.

However as noted above the process is also suitable for 304, 310, 315 and 316 stainless steel.

The process of the present invention protects oxide surfaces on the interior of the coil and also reduces subsequent coking in the TLE for the coil.

The process offers the benefit of minimizing the tube carburization rate by resisting carbon diffusion during the cracking process into the bulk metal of the tube potentially extending tube in-service life. This process also aids in the removal of coke matter in the cooler parts of the cracking process like the transfer line exchangers (TLE) inlets. The ultimate resistance to fouling leads to longer run times, with higher ethylene yields and less stress to the tubes during subsequent decokes. The nitrogenating step has made furnace swings easier because the dimethyl disulphide (DMDS) passivation step is no longer required. DMDS is now used only to limit CO production and to help manage metal dusting. This reduces the expense of the DMDS and improves the environmental risk by requiring fewer loads of DMDS coming to the site.

The present invention has been conducted at both 20:1 and 30:1 steam to nitrogen ratio, the 30:1 ratio will now be illustrated by the following example, refer to FIG. 1.

Example 1

An older Foster Wheeler, 11-pass ethylene cracking furnace at Joffre, Alberta was brought down for a decoke. The following decoke procedure was used:

The coil was subjected to a 30-hour air burn with 2000 kg/hour/coil dilution steam flow. The decoked tube was then subjected to a 2-hour treatment with a mixed flow of steam (the jagged trend line before start of run in FIG. 1) and nitrogen (the relatively straight trend line before start of run in FIG. 1) in a ratio (mass) of 30:1 for a total flow 1750 kg/hour/coil. The tube was then subject to a start-up procedure using a high rate of dilution steam.

The furnace remained onstream for 227 days (the relatively straight trend line after start of run in FIG. 1) for its turnaround. The jagged trend line after start of run in FIG. 1 depicts the fouling rate of the coils during the run.

Figure 2:
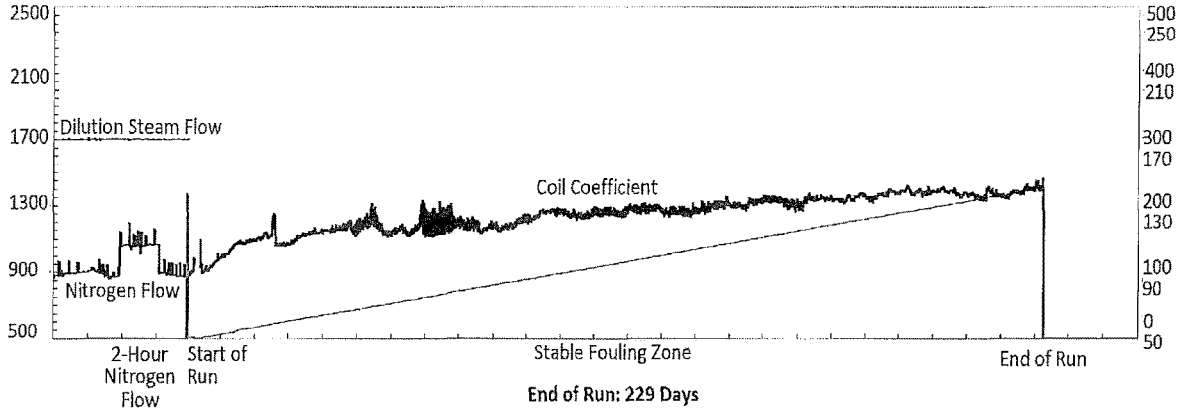
FIG. 2 shows the fun time of the furnace treated in accordance with Example 1.

The present invention has been conducted at both 20:1 and 30:1 steam to nitrogen ratio, the 20:1 ratio will now be illustrated by the following second example, refer to FIG. 2.

Example 2

An older Stone and Webster, 4-pass ethylene cracking furnace at Joffre, Alberta was brought down for a decoke. The following decoke procedure was used:

The coil was subjected to a 30-hour air burn with 2175 kg/hour/coil dilution steam flow. The decoked tube was then subjected to a 2-hour treatment with a mixed flow of steam (the jagged trend line before start of run in FIG. 2) and nitrogen (the relatively straight trend line before start of run in FIG. 2) in a ratio (mass) of 20:1 for a total flow 2285 kg/hour/coil. The tube was then subject to a start-up procedure using a high rate of dilution steam.

The furnace remained onstream for 165 days (the relatively straight trend line after start of run in FIG. 2) for its turnaround. The jagged trend line after start of run in FIG. 2 depicts the fouling rate of the coils during the run.

INDUSTRIAL APPLICABILITY

The process is applicable for decoking industrial components exposed to high temperatures. The process is applicable for reducing the tendency for carburization of a metal substrate.

The invention claimed is:

1. A process for treating a reactor, the process comprising:

subjecting the reactor to a decoking air burn for a period of time sufficient so that air leaving the reactor has a total carbon oxide content less than 2,000 ppm, wherein the reactor is for the conversion of a chemicals feedstock at a temperature greater than 700° C.;

scouring a reactor surface with steam via a steam scour at a rate of not less than 2500 kg/hour/reactor for a time from 0.5 to 10 hours giving a scoured reactor surface that contacts hydrocarbons in operation, wherein the decoking air burn is performed prior to the scouring, and wherein the reactor surface and the scoured reactor surface are stainless steel having less than 38 weight % of chromium or wherein the reactor surface and the scoured reactor surface are an alloy having less than 20 weight % of chromium, the alloy being a nickel based alloy or a cobalt based alloy; and treating the scoured reactor surface with a mixture comprising steam and nitrogen in a weight ratio from 20:1 to 30:1 in an amount from 80 to 110 kg/hour per reactor at a temperature from 750° C. to 850° C. for a time not less than 20 minutes, in the absence of added oxygen except for oxygen present in the steam and in the nitrogen, wherein the steam comprises less than 10 parts per billion (ppb) of oxygen and the nitrogen comprises less than 5 parts per million (ppm) of oxygen, wherein treating the scoured reactor surface with the mixture is nitrogenating the scoured reactor surface, wherein the mixture does not comprise an anti-coking agent, wherein the process for treating the reactor does not comprise adding a chemical to reduce coking to the reactor.

2. The process according to claim 1, wherein the reactor comprises stainless steel selected from the group consisting of wrought stainless steel, austenitic stainless steel, HP stainless steel, HT stainless steel, HU stainless steel, HK stainless steel, HW stainless steel, HX stainless steel, heat resistant steel, and nickel based alloys.

3. The process according to claim 2, wherein the stainless steel comprises less than 38 weight % of chromium.

4. The process according to claim 1, wherein the reactor comprises stainless steel selected from the group consisting of 315 stainless steel, 316 stainless steel, austenitic stainless steel, HP stainless steel, HT stainless steel, HU stainless steel, HW stainless steel, and HX stainless steel.

5. The process according to claim 1, wherein the reactor is a cracker for $C_{2-4}$ hydrocarbons.

6. The process according to claim 1, wherein the reactor is a cracker for naphtha, HAC (heavy aromatic concentrate) or HAGO (heavy aromatic gas oils).

7. A method comprising:

subjecting a reactor to a decoking air burn until air leaving the reactor has a total carbon oxide content less than 2,000 parts per million (ppm), wherein the reactor in operation converts chemicals feedstock at a temperature greater than 700° C.;

scouring a reactor surface with steam at a steam scour rate of not less than 2500 kg/hour/reactor for a time from 0.5 to 10 hours to give the reactor surface as a scoured reactor surface, wherein the scoured reactor surface contacts hydrocarbons in operation, wherein the reactor surface and the scoured reactor surface are stainless steel having less than 38 weight % of chromium or wherein the reactor surface and the scoured reactor surface are an alloy having less than 20 weight % of chromium, the alloy being a nickel based alloy or a cobalt based alloy, and wherein the decoking air burn is performed prior to the scouring; and treating the scoured reactor surface with a mixture comprising steam and nitrogen at a weight ratio of the steam to nitrogen from 20:1 to 30:1 with an amount of the mixture from 80 to 110 kg/hour per reactor at a temperature from 750° C. to 850° C. for a time not less than 20 minutes, in the absence of added oxygen except for oxygen present in the steam and in the nitrogen, wherein the steam comprises less than 10 parts per billion (ppb) of oxygen and the nitrogen comprises less than 5 ppm of oxygen, wherein treating the scoured reactor surface with the mixture comprises nitrogenating the scoured reactor surface, wherein the mixture does not comprise an anti-coking agent, and wherein the method does not comprise adding an anti-coking agent to the reactor.

8. The method of claim 7, wherein the reactor comprises stainless steel or a nickel based alloy, or both, and wherein treating the scoured reactor surface with the mixture comprising steam and nitrogen comprises nitrogenating the scoured reactor surface.

9. The method of claim 8, wherein the stainless steel comprises less than 38 weight % of chromium.

10. The method of claim 7, wherein the reactor is a cracker for $C_{2-4}$ hydrocarbons, naphtha, HAC (heavy aromatic concentrate), or HAGO (heavy aromatic gas oils).

11. A method of treating a reactor, comprising:

performing a decoking air burn on the reactor until air leaving the reactor has a total carbon oxide content less than 2,000 parts per million (ppm), wherein the reactor in operation converts chemicals feedstock at a temperature greater than 700° C.;

scouring a reactor surface with steam at a steam scour rate of not less than 2500 kg/hour/reactor for a time from 0.5 to 10 hours to give the reactor surface as a scoured reactor surface, wherein the decoking air burn is performed prior to the scouring, and wherein the reactor surface and the scoured reactor surface are stainless steel having less than 38 weight % of chromium or wherein the reactor surface and the scoured reactor surface are an alloy having less than 20 weight % of chromium, the alloy being a nickel based alloy or a cobalt based alloy; and nitrogenating the scoured reactor surface by treating the scoured reactor surface with a mixture comprising steam and nitrogen in a weight ratio of the steam to nitrogen from 20:1 to 30:1 with an amount of the mixture from 80 to 110 kg/hour per reactor at a temperature from 750° C. to 850° C. for a time not less than 20 minutes, in the absence of added oxygen except for oxygen present in the steam and in the nitrogen, wherein the steam comprises less than 10 parts per billion (ppb) of oxygen and the nitrogen comprises less than 5 ppm of oxygen, wherein the mixture does not comprise an anti-coking agent, wherein the method of treating the reactor does not comprise treating the reactor with a chemical to reduce coking.

12. The method of claim 11, wherein the reactor comprises stainless steel or a nickel based alloy, or both, wherein the stainless steel comprises less than 38 weight % of chromium, and wherein an anti-coking agent is not added to the reactor.

13. The method of claim 11, wherein an anti-coking agent is not added to the reactor, and wherein the reactor is a cracker for $C_{2-4}$ hydrocarbons, naphtha, HAC (heavy aromatic concentrate), or HAGO (heavy aromatic gas oils).

* * * * *